US010036386B2

(12) United States Patent
Smerud et al.

(10) Patent No.: US 10,036,386 B2
(45) Date of Patent: Jul. 31, 2018

(54) STRUCTURE FOR STABILIZING AN ORBITING SCROLL IN A SCROLL COMPRESSOR

(71) Applicant: TRANE INTERNATIONAL INC., Piscataway, NJ (US)

(72) Inventors: Scott Joseph Smerud, La Crosse, WI (US); John Robert Sauls, La Crosse, WI (US); Michael Gerard Benco, Onalaska, WI (US); Jerry Allen Rood, Onalaska, WI (US); Rodney Lakowske, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 484 days.

(21) Appl. No.: 14/448,351

(22) Filed: Jul. 31, 2014

(65) Prior Publication Data

US 2015/0037186 A1 Feb. 5, 2015

Related U.S. Application Data

(60) Provisional application No. 61/860,308, filed on Jul. 31, 2013.

(51) Int. Cl.
*F04C 18/02* (2006.01)
*F04C 23/00* (2006.01)
(Continued)

(52) U.S. Cl.
CPC ..... *F04C 18/0215* (2013.01); *F01C 1/0215* (2013.01); *F01C 17/066* (2013.01);
(Continued)

(58) Field of Classification Search
CPC ..... F04C 18/0215; F04C 23/008; F04C 29/0057; F04C 23/001; F04C 27/005; F01C 17/066; F01C 1/0215; F01C 21/10; Y10T 29/4924
See application file for complete search history.

(56) References Cited

U.S. PATENT DOCUMENTS 4,553,913 A * 11/1985 Morishita ..... F04C 2/025 418/55.5
4,954,057 A * 9/1990 Caillat ..... F01C 1/0215 384/114

(Continued)

*Primary Examiner* — Mark Laurenzi
*Assistant Examiner* — Wesley Harris
(74) *Attorney, Agent, or Firm* — Hamre, Schumann, Mueller & Larson, P.C.

(57) ABSTRACT

A scroll compressor includes one or more stage of compression disposed within a compressor housing. One or more of the stages includes a stationary scroll member including a base and a generally spiral wrap extending from the base of the stationary scroll member. One or more of the stages further includes an orbiting, scroll member including a substantially circular base and a substantially spiral wrap extending from the base of the orbiting scroll member. A coupling is disposed between the first scroll member base and the second scroll member base and in surrounding relationship to the first and second scroll member spiral wraps. At least one stabilizing pad is disposed between the first scroll member base and the second scroll member base and in axial thrust force relationship with the coupling to at least partially prevent tipping of the second scroll member.

16 Claims, 6 Drawing Sheets

(51) Int. Cl.

| | |
|---|---|
| ***F01C 21/10*** | (2006.01) |
| ***F01C 1/02*** | (2006.01) |
| ***F04C 29/00*** | (2006.01) |
| ***F01C 17/06*** | (2006.01) |
| ***F04C 27/00*** | (2006.01) |

(52) U.S. Cl.
CPC ..... *F01C 21/10* (2013.01); *F04C 23/001* (2013.01); *F04C 23/008* (2013.01); *F04C 27/005* (2013.01); *F04C 29/0057* (2013.01); *Y10T 29/4924* (2015.01)

(56) References Cited

U.S. PATENT DOCUMENTS

| | | | | |
|---|---|---|---|---|
| 5,129,798 | A | 7/1992 | Crum et al. | |
| 5,458,471 | A | 10/1995 | Ni | |
| 5,848,883 | A | 12/1998 | Tsubokawa | |
| 5,951,271 | A | 9/1999 | DuMoulin et al. | |
| 6,030,192 | A | 2/2000 | Hill et al. | |
| 6,139,294 | A | 10/2000 | Haller | |
| 6,301,912 | B1 | 10/2001 | Terai et al. | |
| 6,514,060 | B1 | 2/2003 | Ishiguro et al. | |
| 6,672,845 | B1 * | 1/2004 | Kim | F04C 23/008 417/309 |
| 8,231,367 | B2 | 7/2012 | Suefuji et al. | |
| 2005/0123428 | A1 | 6/2005 | Uchida et al. | |
| 2005/0169788 | A1 * | 8/2005 | Komai | F01C 21/10 418/55.6 |
| 2006/0216180 | A1 * | 9/2006 | Yanagisawa | F01C 1/0223 418/55.2 |
| 2010/0158710 | A1 | 6/2010 | Umerura et al. | |
| 2013/0036757 | A1 | 2/2013 | Okaichi et al. | |

* cited by examiner

STRUCTURE FOR STABILIZING AN ORBITING SCROLL IN A SCROLL COMPRESSOR

FIELD

The embodiments described herein relate generally to scroll compressors. More particularly, the embodiments described herein relate to a technique for using thrust pads and/or a back pressure valve to stabilize an orbiting scroll in a scroll compressor.

BACKGROUND

One increasingly popular type of compressor is a scroll compressor. In a scroll compressor, a pair of scroll members orbits relative to each other to compress an entrapped refrigerant.

In typical scroll compressors, a first, stationary, scroll member has a base and a generally spiral wrap extending from its base. A second, orbiting, scroll member has a base and a generally spiral wrap extending from its base. The second, orbiting, scroll member is driven to orbit by a rotating shaft. Some scroll compressors employ an eccentric pin on the rotating shaft that drives the second, orbiting, scroll member.

SUMMARY

In a two-stage scroll compressor, there can be circumstances where there is a moment on one or more orbiting scrolls tending to tip the scroll. This moment can result for example from inertia, gas, friction and bearing forces acting on the scroll at different axial locations. This moment can be offset by a stabilizing moment provided by the thrust surface. The stabilizing moment can be a function of the axial gas force acting on the scroll and thrust bearing geometry. Stable operation occurs for example when there is a positive scroll stability, e.g., when the stabilizing moment is greater than the tipping moment.

Orbiting scroll stability can be an issue in compressor designs that result in higher destabilizing loads, such as for example high speed operation, high drive loads and/or high axial distances between loads, or that result in lower stabilizing loads such as for example at low volume ratios including for example multiple stage compressor designs that may result in relatively lower axial gas forces.

Operational conditions can also affect stability due to their effect of both stabilizing and destabilizing loads. Because of this, a design that is stable at normal operating conditions, for example, can become unstable at extreme conditions such as low discharge pressure conditions.

In view of the foregoing, there is a need to provide a structure that stabilizes an orbiting scroll during its operation, such as in a low volume ratio, and in multiple-stage scroll compressor designs. Orbiting scroll destabilization can be overcome according to one embodiment by some combination of running the scroll compressor at artificially high discharge pressures at unstable conditions caused by insufficient discharge pressure and/or stabilizing pads positioned between the orbiting scroll and a stationary component.

More specifically, a backpressure valve is employed according to one embodiment that ensures for example, that a minimum axial pressure differential across the orbiting scroll is achieved by artificially increasing discharge port pressure.

According to another embodiment, an active discharge pressure control system is employed. The active discharge pressure control system is controlled for example by a combination of suction pressure and compressor speed to ensure for example a minimum axial pressure differential across the orbiting scroll is achieved by artificially increasing discharge port pressure.

According to yet another embodiment, stabilizing pads can be positioned between the orbiting scroll and a stationary component such as for example the fixed scroll with a controlled gap in such a way as to limit orbiting scroll tipping at unstable conditions without measurably increasing power input due to shear losses at stable conditions. In this way, stability can be maintained at conditions that would normally be unstable without affecting compressor performance at stable operating conditions.

DRAWINGS

These and other features, aspects, and advantages of the apparatuses, systems, and methods of using thrust pads and/or a back pressure valve to stabilize an orbiting scroll in a scroll compressor will become better understood when the following detailed description is read with reference to the accompanying drawing, wherein.

Figure 6:
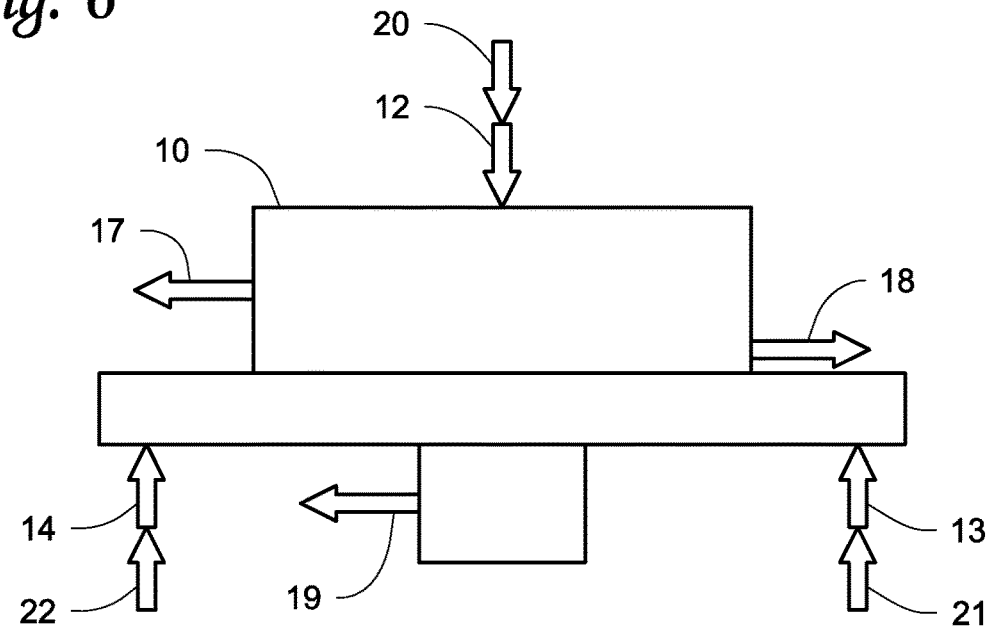
Figure 7:
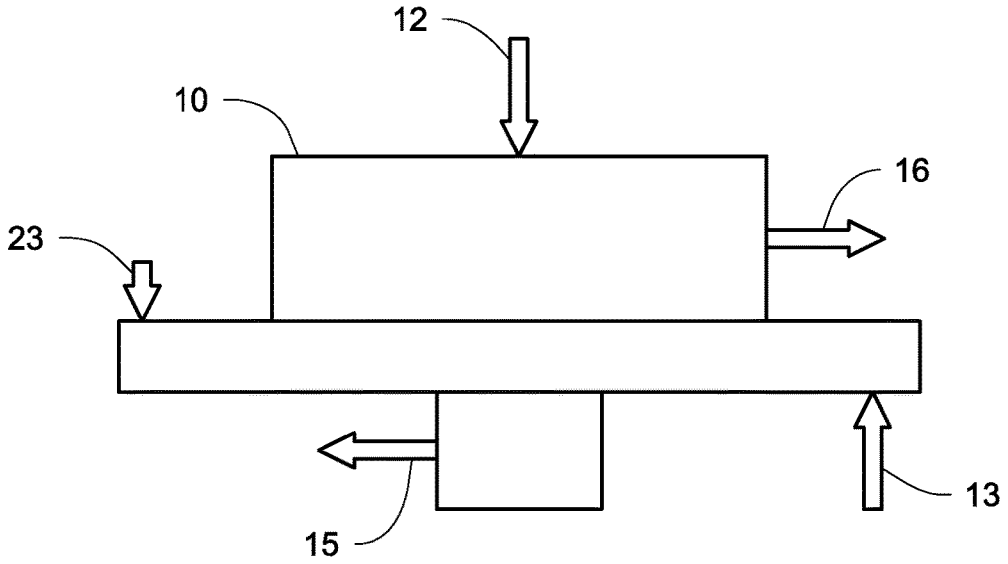
Figure 8:
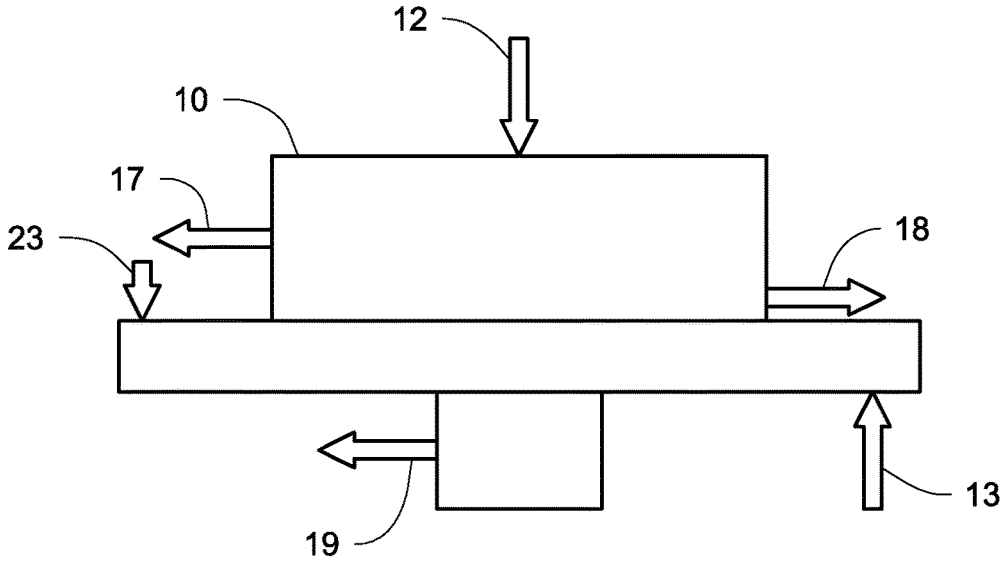
Figure 9:
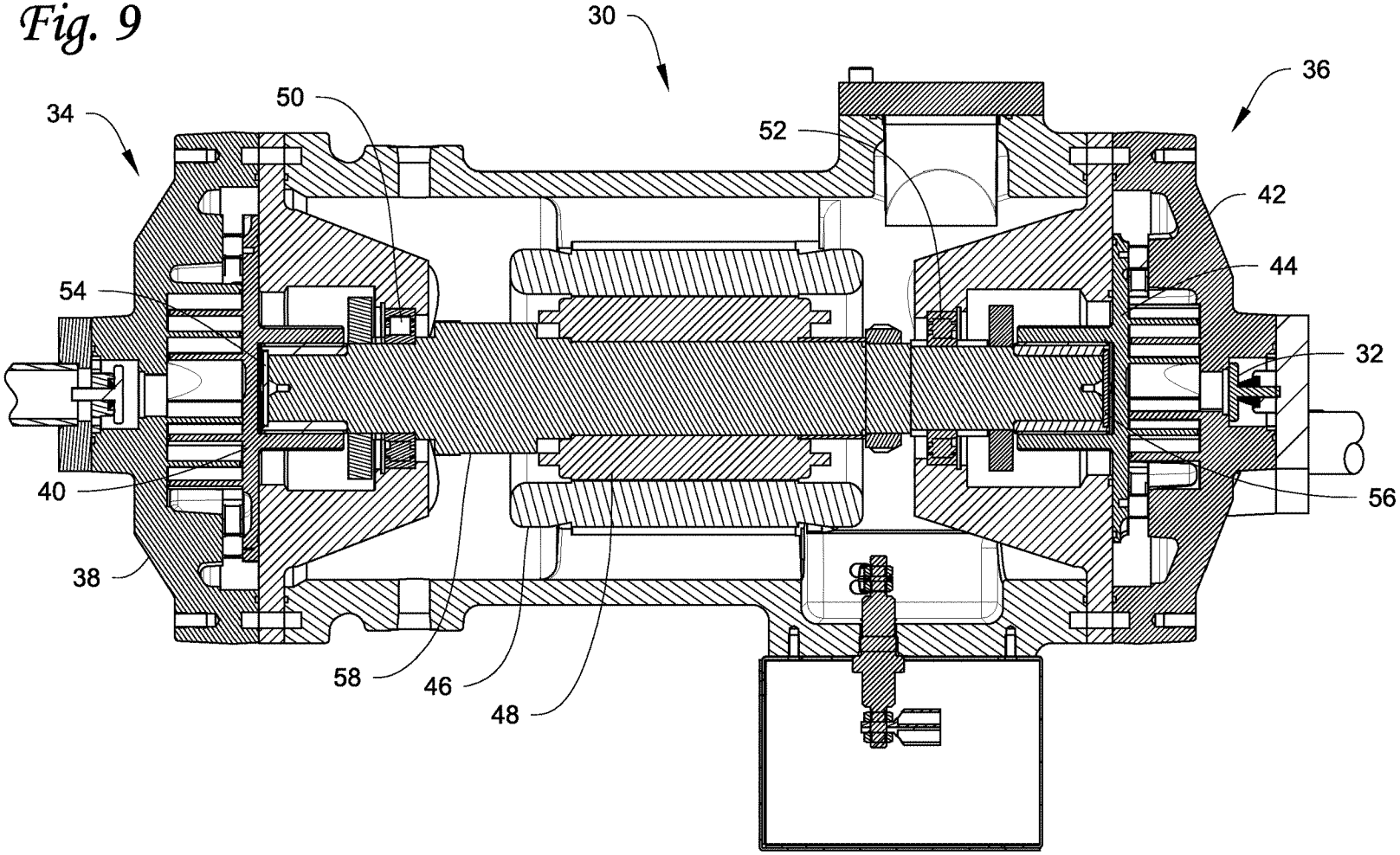
Figure 10:
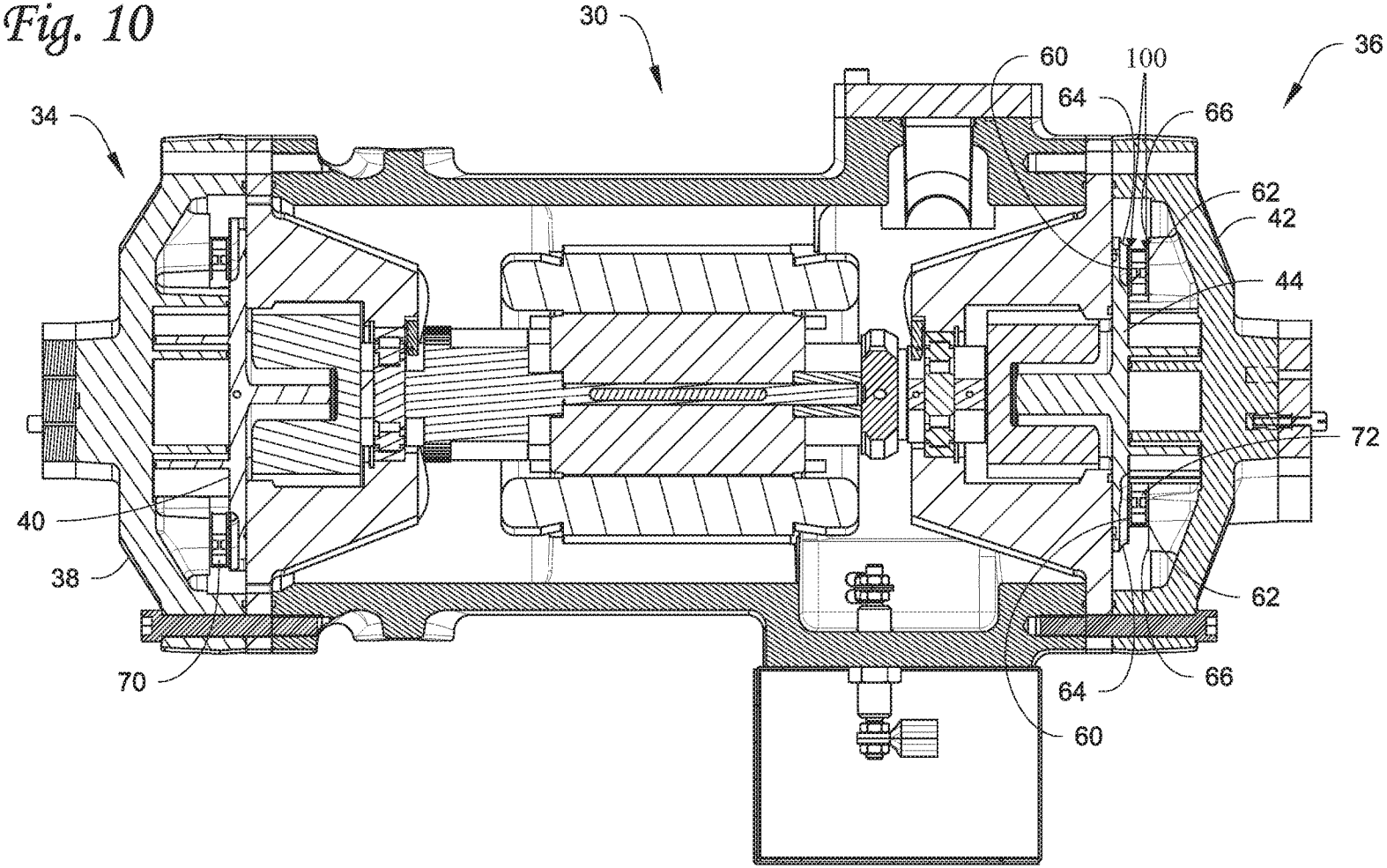

FIG. 6 is a simplified side view of an orbiting scroll illustrating stable orbiting scroll operation in the plane of eccentricity with increased discharge pressure due to axial gas forces (Fag), axial drive forces (Fad), thrust bearing forces (Ftb1), (Ftb2), axial thrust forces (Fat1), (Fat2), radial drive forces (Frd), radial gas forces (Frg) and radial inertia forces (Fri), according to one embodiment;

FIG. 7 is a simplified side view of an orbiting scroll illustrating stable orbiting scroll operation in the plane of velocity with hold-down pads due to axial gas forces (Fag), thrust bearing forces (Ftb1), tangential drive forces (Ftd), tangential gas forces (Ftg) and stabilizing pad forces (Fsp), according to one embodiment;

FIG. 8 is a simplified side view of an orbiting scroll illustrating stable orbiting scroll operation in the plane of eccentricity with hold-down pads due to axial gas forces (Fag), thrust bearing forces (Ftb1), radial drive forces (Frd), radial inertia forces (Fri), radial gas forces (Frg) and stabilizing pad forces (Fsp), according to one embodiment;

FIG. 9 is a side cross-sectional view of a two-stage horizontal scroll compressor with a back pressure valve, according to one embodiment; and FIG. 10 is a side cross-sectional view of a two-stage horizontal scroll compressor with orbiting scroll stabilizing pads and fixed scroll stabilizing pads, according to one embodiment.

While the above-identified drawing figures set forth particular embodiments to the apparatuses, systems, and methods of using thrust pads and/or a back pressure valve to stabilize an orbiting scroll in a scroll compressor, other embodiments are also contemplated, as noted in the discussion. In all cases, this disclosure presents illustrated embodiments by way of representation and not limitation. Numerous other modifications and embodiments can be devised by those skilled in the art which fall within the scope and spirit of the principles described herein.

DETAILED DESCRIPTION

In a two-stage scroll compressor, there can be circumstances where there is a moment on one or more orbiting scrolls tending to tip the scroll. This moment can result for example from inertia, gas, friction and bearing forces that act on the scroll, for example not being applied in the same axial location. This moment can be offset by a stabilizing moment provided by the thrust surface. The stabilizing moment can be a function of the axial gas force acting on the scroll and thrust bearing geometry. Stable operation occurs for example when there is a positive scroll stability, e.g., when the stabilizing moment is greater than the tipping moment. Keeping the foregoing principles in mind, FIGS. 1-8 illustrate some of the major exemplary forces that function to stabilize and destabilize operation of an orbiting scroll in both the plane of velocity and the plane of eccentricity. The descriptions herein can apply to one or more stages of compression that may be present in the compressor.

Figure 1:
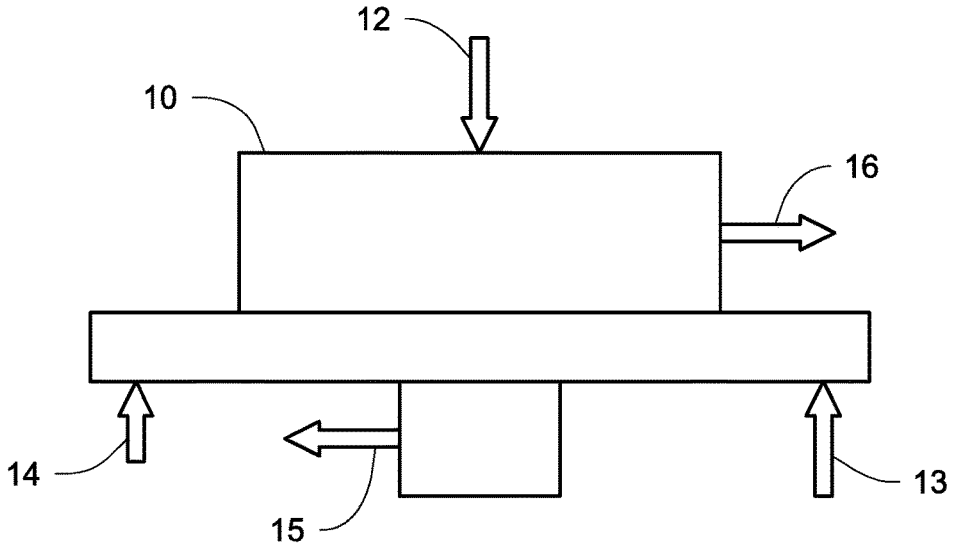
FIG. 1 is a simplified side view of an orbiting scroll illustrating stable orbiting scroll operation in the plane of velocity due to axial gas forces (Fag), thrust bearing forces (Ftb1), (Ftb2), tangential drive forces (Ftd) and tangential gas forces (Ftg), according to one embodiment.

FIG. 1 is a simplified side view of an orbiting scroll 10 illustrating stable orbiting scroll operation in the plane of velocity due to axial gas force (Fag) 12, thrust bearing forces (Ftb1) 13, (Ftb2) 14, tangential drive force (Ftd) 15 and tangential gas force (Ftg) 16, according to one embodiment. In this embodiment, the axial gas force (Fag) 12 and resulting thrust bearing forces (Ftb1, Ftb2) 13, 14 function to provide a stabilizing moment that is greater than the tipping moment created by the tangential gas force (Ftg) 16 and the tangential drive force (Ftd) 15 during operation of the orbiting scroll 10.

Figure 2:
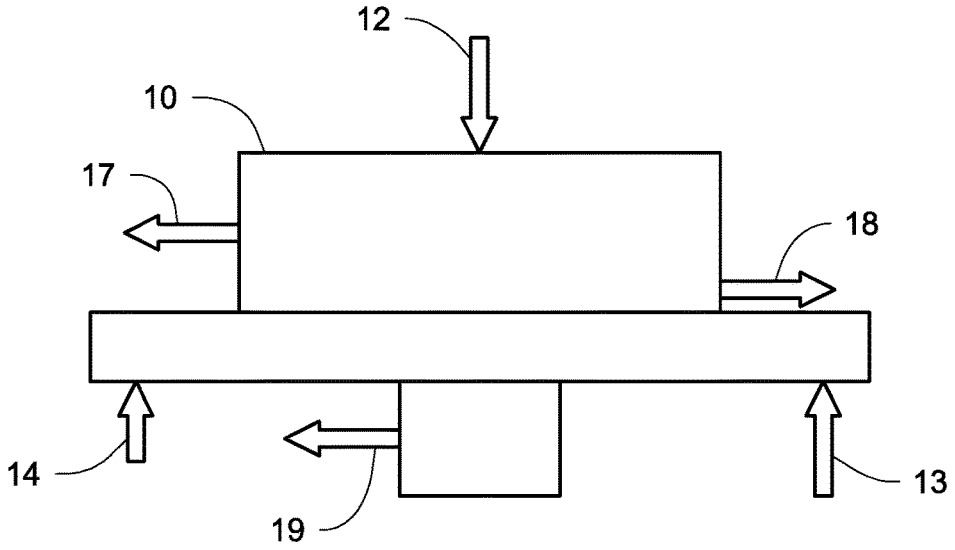
FIG. 2 is a simplified side view of an orbiting scroll illustrating stable orbiting scroll operation in the plane of eccentricity due to axial gas forces (Fag), thrust bearing forces (Ftb1), (Ftb2), radial gas forces (Frg), radial inertia forces (Fri) and radial drive forces (Frd), according to one embodiment.

FIG. 2 is a simplified side view of an orbiting scroll 10 illustrating stable orbiting scroll operation in the plane of eccentricity due to axial gas force (Fag) 12, thrust bearing forces (Ftb1) 13, (Ftb2) 14, radial gas force (Frg) 17, radial inertia force (Fri) 18 and radial drive force (Frd) 19, according to one embodiment. In this embodiment, the axial gas force (Fag) 12 and resulting thrust bearing forces (Ftb1, Ftb2) 13, 14 function to provide a stabilizing moment that is greater than the tipping moment created by the radial gas force (Frg) 17, the radial inertia force (Fri) 18 and the radial drive force (Frd) 19 during operation of the orbiting scroll 10.

Figure 3:
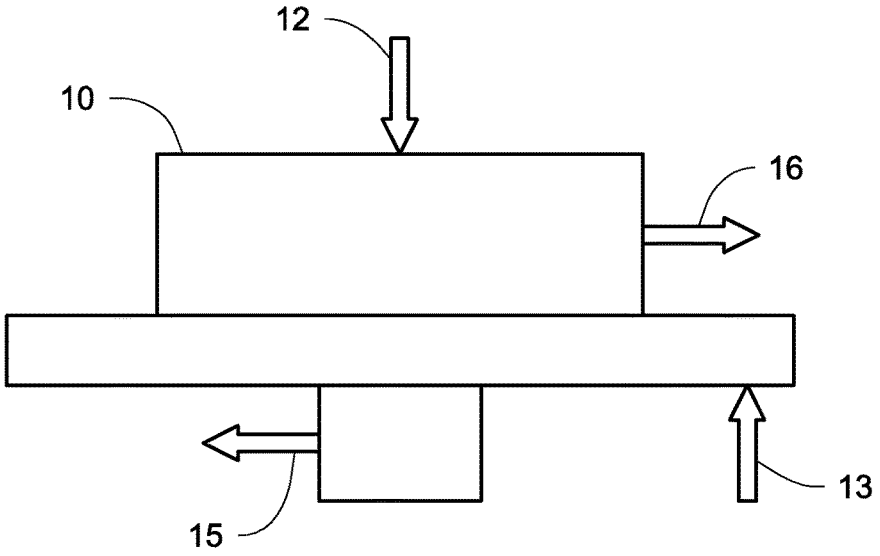
FIG. 3 is a simplified side view of an orbiting scroll illustrating unstable orbiting scroll operation in the plane of velocity due to axial gas forces (Fag), thrust bearing forces (Ftb1), tangential drive forces (Ftd) and tangential gas forces (Ftg), according to one embodiment.

FIG. 3 is a simplified side view of an orbiting scroll 10 illustrating unstable orbiting scroll operation in the plane of velocity due to axial gas force (Fag) 12, thrust bearing force (Ftb1) 13, tangential drive force (Ftd) 15 and tangential gas force (Ftg) 16, according to one embodiment. In this embodiment, the axial gas force (Fag) 12 and resulting thrust bearing force (Ftb1) 13 are not sufficient to overcome the tipping moment created by the tangential gas force (Ftg) 16 and the tangential drive force (Ftd) 15 during operation of the orbiting scroll 10.

Figure 4:
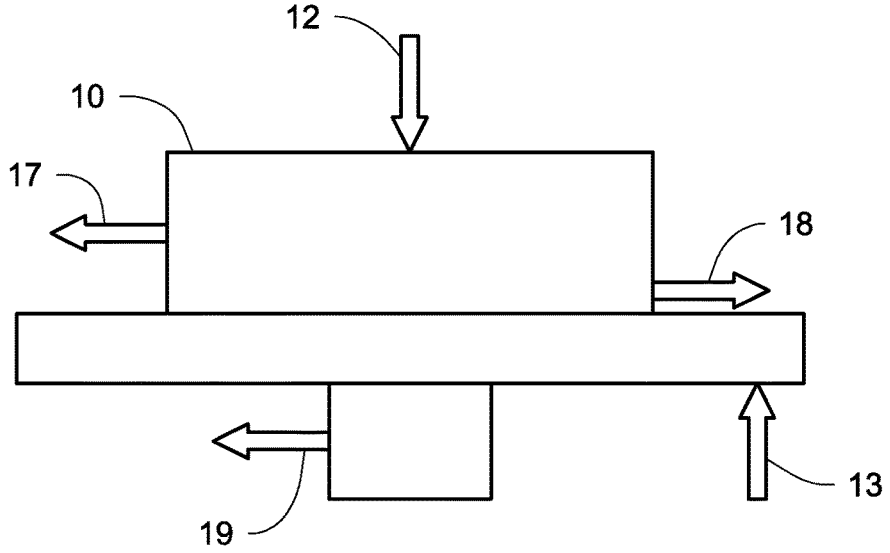
FIG. 4 is a simplified side view of an orbiting scroll illustrating unstable orbiting scroll operation in the plane of eccentricity due to axial gas forces (Fag), thrust bearing forces (Ftb1), radial drive forces (Frd), radial gas forces (Frg) and radial inertia forces (Fri), according to one embodiment.

FIG. 4 is a simplified side view of an orbiting scroll 10 illustrating unstable orbiting scroll operation in the plane of eccentricity due to axial gas force (Fag) 12, thrust bearing force (Ftb1) 13, radial drive force (Frd) 19, radial gas force (Frg) 17 and radial inertia force (Fri) 18, according to one embodiment. In this embodiment, the axial gas force (Fag) 12 and resulting thrust bearing force (Ftb1) 13 are not sufficient to overcome the tipping moment created by the radial gas force (Frg) 17, the radial inertia force (Fri) 18 and the radial drive force (Frd) 19 during operation of the orbiting scroll 10.

Figure 5:
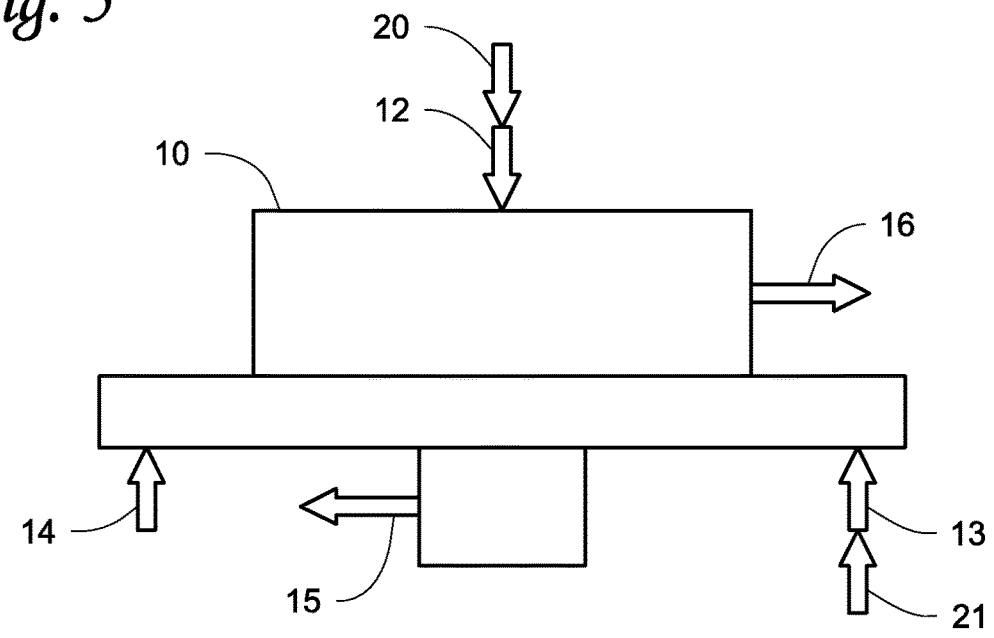
FIG. 5 is a simplified side view of an orbiting scroll illustrating stable orbiting scroll operation in the plane of velocity with increased discharge pressure due to axial gas forces (Fag), thrust bearing forces (Ftb1), (Ftb2), tangential drive forces (Ftd), tangential gas forces (Ftg) and axial drive forces (Fad), according to one embodiment.

FIG. 5 is a simplified side view of an orbiting scroll 10 illustrating an embodiment to stabilize orbiting scroll operation in the load case shown, for example in FIG. 3 in the plane of velocity by increasing axial gas force due to additional discharge pressure (Fad) 20. In this embodiment, the additional discharge force (Fad) 20, axial gas force (Fag) 12 and resulting thrust bearing forces (Ftb1) 13, (Fat1) 21, and (Fat2) 22 (see e.g. FIG. 6) are sufficient to overcome the tipping moment created by the tangential gas force (Ftg) 16 and the tangential drive force (Ftd) 15 during operation of the orbiting scroll 10.

FIG. 6 is a simplified side view of an orbiting scroll 10 illustrating an embodiment to stabilize orbiting scroll operation in the load case shown in FIG. 4 in the plane of eccentricity by increasing axial gas force due to additional discharge pressure (Fad) 20. In this embodiment, the additional discharge force (Fad) 20, axial gas force (Fag) 12, and resulting thrust bearing forces (Ftb1) 13, (Fat1) 21 (see FIG. 5), and (Fat2) 22 are sufficient to overcome the tipping moment created by the radial gas force (Frg) 17, the radial inertia force (Fri) 18 and the radial drive force (Ftd) 19 during operation of the orbiting scroll 10.

FIG. 7 is a simplified side view of an orbiting scroll 10 illustrating an embodiment to stabilize orbiting scroll operation in the load case shown in FIG. 3 in the plane of velocity with a force (Fsp) 23 obtained by the use of stabilizing pads. In this embodiment, the axial gas force (Fag) 12 and thrust bearing force (Ftb1) 13 and stabilizing pad force (Fsp) 23 are sufficient to overcome the tipping moment created by the tangential gas force (Ftg) 16 and the tangential drive force (Ftd) 15 during operation of the orbiting scroll 10.

FIG. 8 is a simplified side view of an orbiting scroll 10 illustrating an embodiment to stabilize orbiting scroll operation in the load case shown in FIG. 4 in the plane of eccentricity with a force (Fsp) 23 obtained by the use of stabilizing pads. In this embodiment, the axial gas force (Fag) 12, thrust bearing force (Ftb1) 13 and stabilizing pad force (Fsp) 23 are sufficient to overcome the tipping moment created by the radial gas force (Frg) 17, radial inertia force (Fri) 18 and radial drive force (19) during operation of the orbiting scroll 10.

FIG. 9 is a side cross-sectional view of a two-stage horizontal scroll compressor 30 depicting a back pressure valve which may be internal 32 or external to the compressor, according to one embodiment. Although particular embodiments are described herein with respect to horizontal double-ended two-stage scroll compressors, it will be appreciated the principles described herein are not so limited, and may just as easily be applied to multi-stage scroll compressors having more than two stages as well as single-stage scroll compressors.

The two-stage horizontal scroll compressor 30 comprises a first, input stage 34 and a second, output stage 36. The first, input stage 34 comprises a fixed, non-orbiting scroll member 38 and an orbiting scroll member 40. The non-orbiting scroll member 38 is positioned in meshing engagement with the orbiting scroll member 40.

The second, output stage 36 also comprises a fixed, non-orbiting scroll member 42 and an orbiting scroll member 44. The second stage non-orbiting scroll member 42 is positioned in meshing engagement with the second stage orbiting scroll member 44.

Scroll compressor 30 further comprises a compressor drive shaft 58 or crankshaft extending between the first, input stage 34 and the second, output stage 36. The crankshaft 58 may be rotatably driven, by way of example and not limitation, via an electric motor comprising a wound stator 46 and a rotor 48 which may be in an interference type fit on the compressor crankshaft 58. The crankshaft 58 may be rotatably journaled within one or more main bearings 50, 52. Each crankshaft main bearing 50, 52 may comprise, by way of example and not limitation, a rolling element bearing having a generally cylindrical portion.

According to one embodiment, the first stage 34 further comprises a conventional hydrodynamic type orbiting scroll thrust bearing 54; while the second stage of compression 36 further comprises a hydrostatic type orbiting scroll thrust bearing 56.

In a practical two-stage scroll compressor, one of the orbiting scrolls may operate with an axial pressure differential across the orbiting scroll base plate. An orbiting scroll that is stable at normal operating conditions can become unstable at extreme conditions such as low discharge pressure conditions. This problem can be overcome by some combination of running the scroll compressor at artificially high discharge pressures at unstable conditions caused by insufficient discharge pressure and/or stabilizing pads positioned between the orbiting scroll and a stationary component, such as described herein with reference to FIGS. 9 and 10.

With continued reference to FIG. 9, the backpressure valve 32 can be provided to function so as to ensure that a minimum axial pressure differential is maintained across the orbiting scroll 44 by artificially increasing the discharge pressure of the second stage 36, according to one embodiment. According to another embodiment, an active discharge pressure control system that is responsive, for example, to suction pressure and compressor speed may also function to ensure that a minimum or a suitable axial pressure differential is maintained across the orbiting scroll 44, depending on for example the operating condition. It can be appreciated that one or more than one stage of compression may employ a backpressure valve or an active discharge pressure control system to ensure a minimum or a suitable axial pressure differential is maintained across the respective orbiting scroll.

FIG. 10 is another side cross-sectional view of the two-stage horizontal scroll compressor 30 depicting various stabilizing structures, such as for example couplings, e.g. Oldham coupling pads 60, 62, orbiting scroll stabilizing pads 64 and fixed scroll pads 66, according to one embodiment. One or both stages may incorporate such stabilizing pads, fixed scroll pads and/or Oldham coupling pads, depending upon the application. It will be appreciated that single scroll orbiting structures as well as multiple set single stage structures may employ the principles described herein. The stabilizing structures 60, 62, 64, 66 in some embodiments are positioned between the orbiting scroll 44 and a stationary component such as the fixed scroll 42 with a controlled gap 100. In some embodiments, the controlled gap 100 can be in the range of about 0.02 to 0.3 mm, but such a range is merely exemplary and not meant to be limiting. It will be appreciated that the stabilizing structures and controlled gap 100 can be configured in such a way as to limit orbiting scroll tipping at unstable conditions without measurably increasing power input due to shear losses at stable conditions. In this way, stability can be maintained for example at conditions that would normally be unstable without affecting compressor performance at stable operating conditions, as stated herein.

Looking again at FIG. 10, two-stage horizontal scroll compressor 30 comprises a first, input stage 34 and a second, output stage 36. The first, input stage 34 comprises a fixed, non-orbiting scroll member 38 and an orbiting scroll member 40. The non-orbiting scroll member 38 is positioned in meshing engagement with the orbiting scroll member 40.

The second, output stage 36 also comprises a fixed, non-orbiting scroll member 42 and an orbiting scroll member 44. The second stage non-orbiting scroll member 42 is positioned in meshing engagement with the second stage orbiting scroll member 44.

The first, input stage 34 may further comprise an Oldham coupling enumerated as 70 in FIG. 10. In similar fashion, the second, output stage 36 may comprise an Oldham coupling 72. Numerous Oldham coupling structures are well known in the compressor art, and so further details are not discussed herein.

According to one embodiment, scroll compressor 30 may further comprise orbiting scroll stabilizing pads 64 protruding from the second stage orbiting scroll 44 in some circumstances. The scroll compressor 30 may further comprise stationary pads 66 protruding from the output stage non-orbiting scroll member 42 in some circumstances. In some embodiments, the scroll compressor 30 further may comprise a pad 60 protruding from the Oldham coupling 72 in the space between the Oldham coupling 72 and the orbiting scroll 44 in some circumstances. A pad 62 may further protrude from the Oldham coupling 72 in the space between the Oldham coupling 72 and the second stage non-orbiting scroll member 42 in some circumstances. The pads 60, 62 can advantageously provide additional stabilization from axial/thrust forces associated with the Oldham coupling(s) 70, 72.

The stabilizing pads 60, 62, 64, 66 are positioned between the orbiting scroll 44 and a stationary component such as the fixed scroll 42 with a controlled gap 100 in such a way as to limit orbiting scroll tipping at unstable conditions without measurably increasing power input due to shear losses at stable conditions. In this way, stability can be maintained for example at conditions that would normally be unstable without affecting compressor performance at stable operating conditions, as stated herein.

Earlier attempts at improving the stability of orbiting scrolls have focused primarily on limiting orbiting scroll inertia forces by limiting orbiting scroll weight, compressor speed or compressor orbit radius thereby reducing the number of design options that could be considered. The embodiments described herein can advantageously employ stabilization pads and/or back pressure allowing stability to be controlled for example at conditions that would normally be unstable in a structure that can be optimized at targeted design points. It will be appreciated that stabilizing pads and back pressure valves may be used individually or in combination depending upon the particular application to increase orbiting scroll stability and/or limit orbiting scroll tipping.

In summary explanation, a backpressure valve is employed in a scroll compressor according to one embodiment that ensures a suitable or a minimum axial pressure differential across an orbiting scroll is achieved by artificially increasing the scroll compressor discharge pressure. Stabilizing pads may also be positioned between the orbiting scroll and a stationary component such as the fixed scroll with a controlled gap in such a way as to limit orbiting scroll tipping at unstable conditions without measurably increasing power input due to shear losses at stable conditions. In this way, stability can be maintained for example at conditions that would normally be unstable without affecting compressor performance at stable operating conditions.

It will be appreciated that, while horizontal orientation of a scroll compressors are discussed and shown, the stabilizing structures described herein can apply to and be suitable for vertically oriented scroll compressors.

Any aspects 1 to 9 can be combined with any aspects 10-22.

Aspect 1. A scroll compressor, comprising: a compressor housing; an output stage of compression disposed within the compressor housing, the output stage comprising: a first, stationary, scroll member comprising a base and a generally spiral wrap extending from the base of the first, stationary, scroll member; and a second, orbiting, scroll member comprising a substantially circular base and a generally spiral wrap extending from the base of the second, orbiting scroll member; a coupling disposed between the first scroll member base and the second scroll member base and in surrounding relationship to the first and second scroll member spiral wraps; one or more stabilizing pads disposed on the base of the first scroll member and configured to at least partially stabilize an axial thrust force between the coupling and the base of the first scroll member to at least partially prevent tipping of the second scroll member; one or more stabilizing pads disposed on the base of the second scroll member and configured to at least partially stabilize an axial thrust force between the coupling and the base of the second scroll member to at least partially prevent tipping of the second scroll member; one or more stabilizing pads disposed on the first scroll member base side of the coupling and configured to at least partially stabilize an axial thrust force between the coupling and the base of the first scroll member to at least partially prevent tipping of the second scroll member; and one or more stabilizing pads disposed on the second scroll member base side of the coupling and configured to at least partially stabilize an axial thrust force between the coupling and the base of the second scroll member to at least partially prevent tipping of the second scroll member.

Aspect 2. The scroll compressor according to aspect 1, further comprising: an input stage of compression disposed within the compressor housing, the input stage comprising: a third, stationary, scroll member comprising a base and a generally spiral wrap extending from the base of the third, stationary, scroll member; and a fourth, orbiting, scroll member comprising a substantially circular base and a generally spiral wrap extending from the base of the fourth, orbiting scroll member; another coupling disposed between the third scroll member base and the fourth scroll member base and in surrounding relationship to the third and fourth scroll member spiral wraps; one or more stabilizing pads disposed on the base of the third scroll member and configured to at least partially stabilize an axial thrust force between the another coupling and the base of the third scroll member to at least partially prevent tipping of the fourth scroll member; one or more stabilizing pads disposed on the base of the fourth scroll member and configured to at least partially stabilize an axial thrust force between the another coupling and the base of the fourth scroll member to at least partially prevent tipping of the fourth scroll member; one or more stabilizing pads disposed on the third scroll member base side of the another coupling and configured to at least partially stabilize an axial thrust force between the another coupling and the base of the third scroll member to at least partially prevent tipping of the fourth scroll member; and one or more stabilizing pads disposed on the fourth scroll member base side of the another coupling and configured to at least partially stabilize an axial thrust force between the another coupling and the base of the fourth scroll member to at least partially prevent tipping of the fourth scroll member.

Aspect 3. The scroll compressor according to aspect 2, wherein the input stage of compression further comprises a backpressure valve configured to create a predetermined minimum axial thrust pressure differential across the fourth, orbiting scroll member.

Aspect 4. The scroll compressor according to any of aspects 1 to 3, wherein the scroll compressor is a single-stage scroll compressor.

Aspect 5. The scroll compressor according to any of aspects 1 to 4, wherein the scroll compressor is a double-ended two-stage scroll compressor.

Aspect 6. The scroll compressor according to any of aspects 1 to 5, wherein the scroll compressor comprises more than two sets of single stage compression.

Aspect 7. The scroll compressor according to any of aspects 1 to 6, wherein the scroll compressor is a horizontal scroll compressor.

Aspect 8. The scroll compressor according to any of aspects 1 to 7, further comprising an orbiting scroll hydrostatic thrust bearing configured to limit thrust loading on the substantially circular base of the second, orbiting, scroll member.

Aspect 9. The scroll compressor according to any of aspects 1 to 8, wherein the output stage further comprises a backpressure valve configured to create a predetermined minimum axial thrust pressure differential across the second, orbiting scroll member.

Aspect 10. A scroll compressor, comprising: an output stage of compression disposed within a compressor housing, the output stage comprising: a first, stationary scroll member comprising a base and a generally spiral wrap extending from the base of the stationary scroll member; and a second, orbiting, scroll member comprising a substantially circular base and a substantially spiral wrap extending from the base of the orbiting scroll member; an coupling disposed between the first scroll member base and the second scroll member base and in surrounding relationship to the first and second scroll member spiral wraps; and at least one stabilizing pad disposed between the first scroll member base and the second scroll member base and in axial thrust force relationship with the coupling to at least partially prevent tipping of the second scroll member.

Aspect 11. The scroll compressor according to aspect 10, wherein at least one stabilizing pad protrudes from the base of the first scroll member and is configured to at least partially stabilize an axial thrust force between the coupling and the base of the first scroll member to at least partially prevent tipping of the second scroll member.

Aspect 12. The scroll compressor according to any of aspects 10 or 11, wherein at least one stabilizing pad protrudes from the base of the second scroll member and is configured to at least partially stabilize an axial thrust force between the coupling and the base of the second scroll member to at least partially prevent tipping of the second scroll member.

Aspect 13. The scroll compressor according to any of aspects 10 to 12, wherein at least one stabilizing pad protrudes from the first scroll member base side of the coupling and is configured to at least partially stabilize an axial thrust force between the coupling and the base of the first scroll member to at least partially prevent tipping of the second scroll member.

Aspect 14. The scroll compressor according to any of aspects 10 to 13, wherein at least one stabilizing pad protrudes from the second scroll member base side of the coupling and is configured to at least partially stabilize an axial thrust force between the coupling and the base of the second scroll member to at least partially prevent tipping of the second scroll member.

Aspect 15. The scroll compressor according to any of aspects 10 to 14, wherein the output stage of compression further comprises a backpressure valve configured to create a predetermined minimum axial thrust pressure differential across the second, orbiting scroll member.

Aspect 16. The scroll compressor according to any of aspects 10 to 15, further comprising: an input stage of compression disposed within the compressor housing, the input stage comprising: a third, stationary, scroll member comprising a base and a generally spiral wrap extending from the base of the third, stationary, scroll member; and a fourth, orbiting, scroll member comprising a substantially circular base and a generally spiral wrap extending from the base of the fourth, orbiting scroll member; another coupling disposed between the third scroll member base and the fourth scroll member base and in surrounding relationship to the third and fourth scroll member spiral wraps; and at least one stabilizing pad disposed between the third scroll member base and the fourth scroll member base and in axial thrust force relationship with the another coupling.

Aspect 17. The scroll compressor according to aspect 16, wherein the input stage of compression further comprises a backpressure valve configured to create a predetermined minimum axial thrust pressure differential across the fourth, orbiting scroll member.

Aspect 18. The scroll compressor according to any of aspects 10 to 17, wherein the scroll compressor is a single-stage scroll compressor.

Aspect 19. The scroll compressor according to any of aspects 10 to 18, wherein the scroll compressor is a double-ended two-stage scroll compressor.

Aspect 20. The scroll compressor according to any of aspects 10 to 19, wherein the scroll compressor comprises more than two sets of single stage compression.

Aspect 21. The scroll compressor according to any of aspects 10 to 20, wherein the scroll compressor is a horizontal scroll compressor.

Aspect 22. The scroll compressor according to any of aspects 10 to 21, further comprising an orbiting scroll hydrostatic thrust bearing configured to limit thrust loading on the substantially circular base of the orbiting scroll member.

While the embodiments have been described in terms of various specific embodiments, those skilled in the art will recognize that the embodiments can be practiced with modification within the spirit and scope of the claims.

What is claimed is:

1. A scroll compressor, comprising:

a compressor housing;

an output stage of compression disposed within the compressor housing, the output stage comprising:

a first, stationary, scroll member comprising a base and a spiral wrap extending from the base of the first, stationary, scroll member; and a second, orbiting, scroll member comprising a base and a spiral wrap extending from the base of the second, orbiting, scroll member;

a coupling disposed between the base of the first, stationary, scroll member and the base of the second, orbiting, scroll member and in surrounding relationship to the spiral wrap of the first, stationary, scroll member and the spiral wrap of the second, orbiting, scroll member;

an orbiting scroll hydrostatic thrust bearing configured to limit thrust loading on the base of the second, orbiting, scroll member;

the scroll compressor further comprising at least one of:

one or more protrusions disposed on the base of the first, stationary, scroll member and configured to at least partially stabilize an axial thrust force between the coupling and the base of the first, stationary, scroll member to at least partially prevent tipping of the second, orbiting, scroll member, the one or more protrusions disposed between the first, stationary, scroll member and the second, orbiting, scroll member, wherein a gap is maintained between the one or more protrusions and the second, orbiting, scroll member;

one or more protrusions disposed on the base of the second, orbiting, scroll member and configured to at least partially stabilize an axial thrust force between the coupling and the base of the second, orbiting, scroll member to at least partially prevent tipping of the second, orbiting, scroll member, the one or more protrusions disposed between the first, stationary, scroll member and the second, orbiting, scroll member, wherein a gap is maintained between the first, stationary, scroll member and the one or more protrusions;

one or more protrusions disposed on a first, stationary, scroll member base side of the coupling and configured to at least partially stabilize an axial thrust force between the coupling and the base of the first, stationary, scroll member to at least partially prevent tipping of the second, orbiting, scroll member, the one or more protrusions disposed between the first, stationary, scroll member and the coupling, wherein a gap is maintained between the first, stationary, scroll member and the one or more protrusions, or between the one or more protrusions and the second, orbiting, scroll member; and one or more protrusions disposed on a second, orbiting, scroll member base side of the coupling and configured to at least partially stabilize an axial thrust force between the coupling and the base of the second, orbiting, scroll member to at least partially prevent tipping of the second, orbiting, scroll member, the one or more protrusions disposed between the second, orbiting, scroll member and the coupling, wherein a gap is maintained between the first, stationary, scroll member and the one or more protrusions, or between the one or more protrusions and the second, orbiting, scroll member.

2. The scroll compressor according to claim 1, further comprising:

an input stage of compression disposed within the compressor housing, the input stage comprising:

a third, stationary, scroll member comprising a base and a spiral wrap extending from the base of the third, stationary, scroll member; and a fourth, orbiting, scroll member comprising a circular base and a spiral wrap extending from the base of the fourth, orbiting scroll member;

another coupling disposed between the base of the third, stationary, scroll member and the base of the fourth, orbiting, scroll member and in surrounding relationship to the spiral wrap of the third, stationary, scroll member and the spiral wrap of the fourth, orbiting, scroll member;

the scroll compressor further comprising at least one of:

one or more protrusions disposed on the base of the third, stationary, scroll member and configured to at least partially stabilize an axial thrust force between the another coupling and the base of the third, stationary, scroll member to at least partially prevent tipping of the fourth, orbiting, scroll member, the one or more protrusions disposed between the third, stationary, scroll member and the fourth, orbiting, scroll member, wherein a gap is maintained between the fourth, orbiting, scroll member and the one or more protrusions;

one or more protrusions disposed on the base of the fourth, orbiting, scroll member and configured to at least partially stabilize an axial thrust force between the another coupling and the base of the fourth, orbiting, scroll member to at least partially prevent tipping of the fourth, orbiting, scroll member, the one or more protrusions disposed between the third, stationary, scroll member and the fourth, orbiting, scroll member, wherein a gap is maintained between the third, stationary, scroll member and the one or more protrusions;

one or more protrusions disposed on a third, stationary, scroll member base side of the another coupling and configured to at least partially stabilize an axial thrust force between the another coupling and the base of the third, stationary, scroll member to at least partially prevent tipping of the fourth, orbiting, scroll member, the one or more protrusions disposed between the third, stationary, scroll member and the another coupling, wherein a gap is maintained between the third, stationary, scroll member and the one or more protrusions, or between the one or more protrusions and the fourth, orbiting, scroll member; and one or more protrusions disposed on a fourth, orbiting, scroll member base side of the another coupling and configured to at least partially stabilize an axial thrust force between the another coupling and the base of the fourth, orbiting, scroll member to at least partially prevent tipping of the fourth, orbiting, scroll member, the one or more protrusions disposed between the fourth, orbiting, scroll member and the another coupling, wherein a gap is maintained between the third, stationary, scroll member and the one or more protrusions, or between the one or more protrusions and the fourth, orbiting, scroll member.

3. The scroll compressor according to claim 2, wherein the input stage of compression further comprises a backpressure valve configured to create a predetermined minimum axial thrust pressure differential across the fourth, orbiting, scroll member.

4. The scroll compressor according to claim 1, wherein the scroll compressor is one of a single-stage scroll compressor, a double-ended two-stage scroll compressor, and a scroll compressor comprising more than two sets of single stage compression.

5. The scroll compressor according to claim 1, wherein the scroll compressor is a horizontal scroll compressor.

6. The scroll compressor according to claim 1, wherein the output stage further comprises a backpressure valve configured to create a predetermined minimum axial thrust pressure differential across the second, orbiting, scroll member.

7. A scroll compressor, comprising:

an output stage of compression disposed within a compressor housing, the output stage comprising:

a first, stationary, scroll member comprising a base and a spiral wrap extending from the base of the first, stationary, scroll member; and a second, orbiting, scroll member comprising a base and a spiral wrap extending from the base of the second, orbiting, scroll member;

a coupling disposed between the base of the first, stationary, scroll member and the base of the second, orbiting, scroll member and in surrounding relationship to the spiral wrap of the first, stationary, scroll member and the spiral wrap of the second, orbiting, scroll member;

an orbiting scroll hydrostatic thrust bearing configured to limit thrust loading on the base of the second, orbiting, scroll member; and at least one protrusion disposed between the base of the first, stationary, scroll member and the base of the second, orbiting, scroll member and in axial thrust force relationship with the coupling to at least partially prevent tipping of the second, orbiting, scroll member, wherein a gap is maintained between the at least one protrusion and the first, stationary, scroll member, or between the at least one protrusion and the second, orbiting, scroll member.

8. The scroll compressor according to claim 7, wherein the at least one protrusion extends from the base of the first, stationary, scroll member toward the second, orbiting, scroll member and is configured to at least partially stabilize an axial thrust force between the coupling and the base of the first, stationary, scroll member to at least partially prevent tipping of the second, orbiting, scroll member.

9. The scroll compressor according to claim 7, wherein the at least one protrusion extends from the base of the second, orbiting, scroll member toward the first, stationary, scroll member and is configured to at least partially stabilize an axial thrust force between the coupling and the base of the second, orbiting, scroll member to at least partially prevent tipping of the second scroll member.

10. The scroll compressor according to claim 7, wherein the at least one protrusion extends from a first, stationary, scroll member base side of the coupling toward the first, stationary, scroll member and is configured to at least partially stabilize an axial thrust force between the coupling and the base of the first, stationary, scroll member to at least partially prevent tipping of the second, orbiting, scroll member.

11. The scroll compressor according to claim 7, wherein the at least one protrusion extends from a second, orbiting, scroll member base side of the coupling toward the second, orbiting, scroll member and is configured to at least partially stabilize an axial thrust force between the coupling and the base of the second, orbiting, scroll member to at least partially prevent tipping of the second, orbiting, scroll member.

12. The scroll compressor according to claim 7, wherein the output stage of compression further comprises a back-pressure valve configured to create a predetermined minimum axial thrust pressure differential across the second, orbiting scroll member.

13. The scroll compressor according to claim 7, further comprising:

an input stage of compression disposed within the compressor housing, the input stage comprising:

a third, stationary, scroll member comprising a base and a spiral wrap extending from the base of the third, stationary, scroll member; and a fourth, orbiting, scroll member comprising a circular base and a spiral wrap extending from the base of the fourth, orbiting scroll member;

another coupling disposed between the base of the third, stationary, scroll member and the base of the fourth, orbiting, scroll member and in surrounding relationship to the spiral wrap of the third, stationary, scroll member and the spiral wrap of the fourth, orbiting, scroll member; and at least one protrusion disposed between the base of the third, stationary, scroll member and the base of the fourth, orbiting, scroll member and in axial thrust force relationship with the another coupling, wherein a gap is maintained between the third, stationary, scroll member and the at least one protrusion, or between the at least one protrusion and the fourth, orbiting, scroll member.

14. The scroll compressor according to claim 13, wherein the input stage of compression further comprises a back-pressure valve configured to create a predetermined minimum axial thrust pressure differential across the fourth, orbiting, scroll member.

15. The scroll compressor according to claim 7, wherein the scroll compressor is one of a single-stage scroll compressor, a double-ended two-stage scroll compressor, and a scroll compressor comprising more than two sets of single stage compression.

16. The scroll compressor according to claim 7, wherein the scroll compressor is a horizontal scroll compressor.

* * * * *